United States Patent [19]

Gibson et al.

[11] Patent Number: 4,889,300

[45] Date of Patent: Dec. 26, 1989

[54] TRASH BAG SUPPORT WITH COLLAPSIBLE LEGS

[76] Inventors: David E. Gibson, 717 Cynthia St., Alhambra, Calif. 91801; Steven D. Gibson, 8336 Mission Dr., Rosemead, Calif. 91775

[21] Appl. No.: 327,606

[22] Filed: Mar. 23, 1989

[51] Int. Cl.[4] ..... A63B 55/04

[52] U.S. Cl. ..... 248/97; 248/101

[58] Field of Search ..... 248/95, 97, 98, 99, 248/100, 101, 150, 151, 163.1, 165, 166, 439, 172, 173

[56] References Cited

U.S. PATENT DOCUMENTS

| | | | |
|---|---|---|---|
| 128,073 | 6/1872 | Roseborough | 248/97 |
| 575,902 | 1/1897 | Nicholas | 248/97 |
| 3,866,872 | 2/1975 | Burgess | 248/150 |
| 4,157,801 | 6/1979 | Elmer | 248/97 |
| 4,273,167 | 6/1981 | Stillwell | 248/97 |
| 4,562,983 | 1/1986 | Klefbeck | 248/97 |
| 4,759,518 | 7/1988 | Yardas | 248/97 |

FOREIGN PATENT DOCUMENTS

| | | | |
|---|---|---|---|
| 70333 | 12/1949 | Denmark | 248/100 |
| 559559 | 9/1932 | Fed. Rep. of Germany | 248/150 |

*Primary Examiner*—Ramon O. Ramirez
*Assistant Examiner*—Robert A. Olson
*Attorney, Agent, or Firm*—William W. Haefliger

[57] ABSTRACT

A support structure for a flimsy plastic bag including:

(a) a lightweight plastic loop, extending in a horizontal plane and defining a looping axis, (b) sleeves mounted on the loop at at least three spaced apart locations, to pivot, with frictional resistance, about the axis, (c) elongated legs carried by the sleeves to project away from the sleeves sidewardly therefrom whereby the legs may be pivoted between retracted position adjacent a plane defined by the loop, and downwardly extended position to support the loop spaced above a surface above which the legs extend, (d) the loop and sleeves sized to allow folding of the top edge portion of the bag thereover, with the main extent of the bag depending from and below the loop, between the legs.

9 Claims, 1 Drawing Sheet

TRASH BAG SUPPORT WITH COLLAPSIBLE LEGS

BACKGROUND OF THE INVENTION

This invention relates generally to trash bag handling, and more particularly to a collapsible, inexpensive support for trash bags, used for example during their filling.

There is great need for easily usable means to support flimsy plastic trash bags as during the bag filling process. Such bags can be temporarily placed in empty metal trash cans, for filling purposes, but the cans are heavy, clumsy and not collapsible. There is particular need for lightweight means that can be collapsed and easily transported for use in supporting and retaining said bags in open condition during filling.

SUMMARY OF THE INVENTION

It is a major object of the invention to provide highly reliable and practical means meeting the above need. Basically, the invention is embodied in flimsy plastic trash bag support structure that incorporates (a) a lightweight plastic loop, extending in a horizontal plane and defining a looping axis, (b) sleeves mounted on the loop at at least three spaced apart locations, to pivot, with frictional resistance, about said axis, (c) elongated legs carried by the sleeves to project away from the sleeves sidewardly therefrom whereby the legs may be pivoted between retracted positions adjacent a plane defined by the loop, and downwardly extended position to support the loop spaced above a surface above which the legs extend, (d) the loop and sleeves being sized to allow folding of the top edge portion of the bag thereover, with the main extent of the bag depending from and below the loop, between such legs.

It is an additional object to provide in the above environment sleeves that have straight cylindrical bores defining straight axes, the loop having curved extents defining a curved axis extending in the direction of the loop, the loop curved extension frictionally engaging those straight bores to create frictional resistance to sleeve pivoting. As will be seen, the loop curved extent in each sleeve may be continuous or split. In the latter event, the apparatus is even more highly collapsible.

An additional object is to provide an improved molded plastic sleeve having T-shape, with a sideward projection to which a leg is attached.

Yet another object is to provide C-shaped plastic clips removably attached to at least one of the legs, the clips being removable for attachment to the loop, with bag material retained between the clips and loop.

These and other objects and advantages of the invention, as well as the details of an illustrative embodiment, will be more fully understood from the following specification and drawings, in which:

DRAWING DESCRIPTION

DETAILED DESCRIPTION

Figure 1:
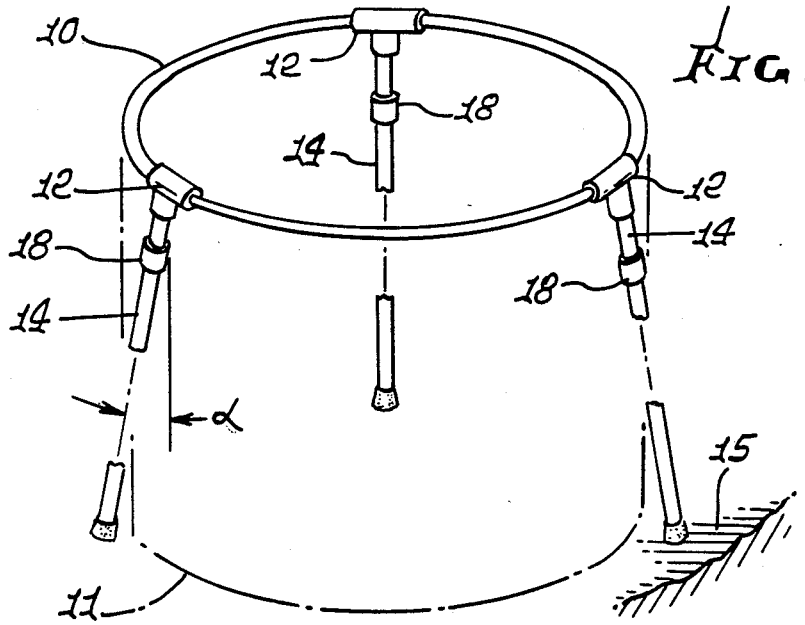
FIG. 1 is a perspective view of the apparatus in extended, i.e. "set up" position, for use.
Figure 6:
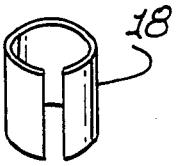
FIG. 6 is a perspective view of a bag retention clip.

In the drawings, loop 10 such as a hollow lightweight plastic tube, has a circumference or length slightly less than the circumference of a fully opened flimsy plastic bag indicated at 11. The loop may be continuous, as in FIG. 3, or in circular arc sections indicated at 10*a* in FIG. 4.

Sleeves 12 are mounted on the loop at at least three circularly spaced apart locations, as for example at 120 intervals. The sleeves may consist of short, straight tubular lengths made of molded plastic material, and their bores 13 are sized to frictionally engage the exterior surface 10*e* of the loop, to allow pivoting of the sleeves about the loop axis 10*b* yet to frictionally retain the sleeves in selected position.

Figure 2:
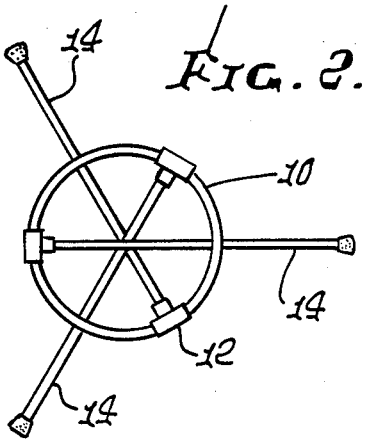
FIG. 2 is a plan view showing the apparatus in folded or retracted (collapsed) condition, for portability.

Elongated legs 14 are carried by the sleeves to project away from the sleeves, sidewardly therefrom, whereby the legs may be forcibly pivoted or swung, about axis 10*b*, between retracted positions (see FIG. 2) adjacent a horizontal plane defined by the loop, and downwardly extended positions as seen in FIG. 1. In the latter, the legs support the loop, via the sleeves, spaced above the horizontal ground surface 15; and the legs typically diverge downwardly away from a vertical axis at the center of the horizontal loop, and at an angle $\alpha$ between 5 and 25, during support of the trash bag. Typically the legs have upper extents 14*a* received in and bonded to bores 12*b* defined by side projections 16 integral with the sleeves. Thus, the sleeves and projections have T-shape.

The loop and sleeves are sized to allow folding of the top annular edge portion 11*a* of the bag 11 closely over the loop, with the main extent of the bag hanging downward below the inner side of the loop and between the legs. Therefore the upper end of the bag is open and supported, to receive trash.

Figure 5:
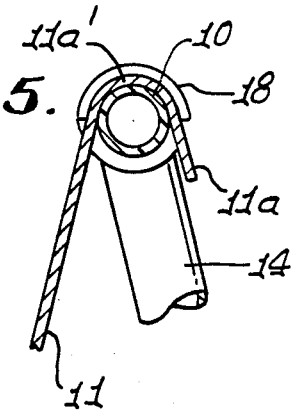
FIG. 5 is a vertical section showing attachment of a clip to the loop, with an upper edge portion of a plastic bag retained between the clip and loop.

C-shaped clips 18, typically made of molded plastic, can be removably and quickly attached to the loop, as seen in FIG. 5 with local extent 11*a'* of the bag top folded edge portion retained between the clip inner surface and the loop. Note that the clip typically is made of plastic and has a straight cylindrical bore. The legs and loop have about the same outer diameters, whereby the clips can be stored in resiliently clipped on position, on the legs (see FIG. 2) prior to their removal and attachment to the loop to hold the bag in place.

Figure 3:
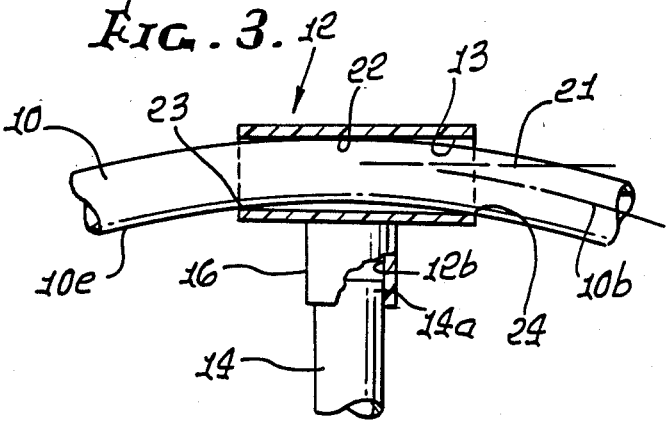
FIGS. 3 and 4 are fragmentary views showing frictional attachment of sleeves to loop extents.

FIG. 3 shows that the sleeve 12 typically has a substantially straight bore 13 and defines a straight axis 21 whereas the loop has a curved axis 10*b* extending generally in a circle. This allows for frictional engagement of the bore 13 with the loop surface at three locations 22–24, to frictionally resist pivoting of the legs and sleeves about axis 10*b* when the legs are supporting the loop and trash bag.

Figure 4:
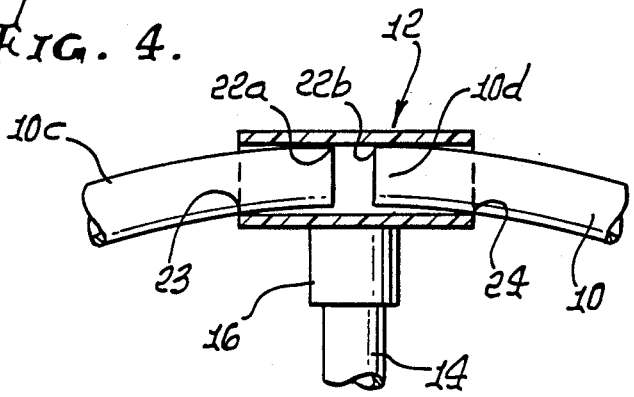

In FIG. 4 the loop is constructed in three sections 10*c*, each extending about 120°, to have ends 10*d* that extend into the sleeves 12 and frictionally engage the bore 20 at 22*a*, 22*b*, 23 and 24. Thus, sections 10*c* are supported by the sleeves, to extend in a loop, and to in turn support the trash bag. This enhances collapsibility of the device, for storage and portability.

Clips 18 may be attached to the loop, or the legs, as by strings, to prevent their misplacement.

I claim:

1. A support structure for a flimsy plastic bag, comprising (a) a lightweight plastic loop, about which the loop extends to define substantially a circle in a horizontal plane and defining a looping axis, (b) sleeves mounted on the loop at at least three spaced apart locations, to pivot, with frictional resistance, about said axis, (c) elongated legs carried by said sleeves to project away from the sleeves sidewardly therefrom whereby the legs may be pivoted between retracted positions adjacent a plane defined by the loop, and downwardly extended positions to support the loop spaced above a surface above which the legs extend, each leg, beyond its associated sleeve, being of single-piece construction and having a length substantially greater than the diameter of the plastic circular loop, whereby in retracted position the legs extend in overlapping relations proximate said axis and project outwardly of the loop circle, (d) the loop and sleeves sized to allow folding of the top edge portion of the bag thereover, with the main extent of the bag depending from and below the loop, between said legs, (e) said sleeves having straight cylindrical bores defining straight axes, said loop having curved extents defining a curved axis extending in the direction of the loop, said loop curved extents frictionally engaging said straight bores to create frictional resistance to sleeve pivoting, whereby the legs are frictionally held in said overlapping relation when the legs are in said retracted positions.

2. The bag support structure of claim 1 wherein the loop curved extent in each sleeve is one of the following:

(1) continuous (2) split.

3. The bag support structure of claim 1 wherein said sleeves consist of light weight plastic material.

4. The bag support structure of claim 1 wherein each sleeve has T-shape, with a sideward projection to which a leg is attached.

5. The bag support structure of claim 1 including C-shaped plastic clips removably attached to at least one of the legs, the clips being removable for attachment to the loop, with bag material adapted to be retained between the clips and loop.

6. The bag support structure of claim 5 wherein the legs and loop have substantially the same outer diameters.

7. The bag support structure of claim 1 including said bag adapted to have its top edge portion overlying the loop clips removably attached to the loop, with local extent of the bag top edge portions adapted to be retained between the clips and the loop, the loop having circular cross sections.

8. The bag support structure of claim 1 wherein said loop is generally circular, said sleeves being located at approximately 120° intervals about the loop.

9. The bag support of claim 1 wherein said loop is circular, said sleeves being located at approximately 120° intervals about the loop, and including said bag adapted to have its said top edge portion overlying said loop and clips attaching the bag top edge portion to the loop, at locations between said sleeves.

* * * * *